US008097390B2

(12) United States Patent
Yanagida

(10) Patent No.: US 8,097,390 B2
(45) Date of Patent: Jan. 17, 2012

(54) ELECTROPHOTOGRAPHIC TONER, INVISIBLE ELECTROPHOTOGRAPHIC TONER, ELECTROPHOTOGRAPHIC DEVELOPER, TONER CARTRIDGE, PROCESS CARTRIDGE, AND IMAGE FORMATION APPARATUS

(75) Inventor: Kazuhiko Yanagida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 349 days.

(21) Appl. No.: 12/545,483

(22) Filed: Aug. 21, 2009

(65) Prior Publication Data

US 2010/0203437 A1 Aug. 12, 2010

(30) Foreign Application Priority Data

Feb. 12, 2009 (JP) ..... 2009-029627

(51) Int. Cl.
*G03G 9/09* (2006.01)

(52) U.S. Cl. ..... 430/108.21; 430/108.1; 430/108.2; 399/159

(58) Field of Classification Search ..... 430/108.1, 430/108.2, 108.21; 399/159
See application file for complete search history.

(56) References Cited

U.S. PATENT DOCUMENTS 5,346,797 A 9/1994 Kmiecik-Lawrynowicz et al.
(Continued)

FOREIGN PATENT DOCUMENTS

JP A-4-233683 8/1992
(Continued)

*Primary Examiner* — Peter Vajda
(74) *Attorney, Agent, or Firm* — Oliff & Berridge, PLC

(57) ABSTRACT

The invention provides an electrophotographic toner containing at least a binder resin and an infrared absorber, the infrared absorber comprising a perimidine-squarylium dye represented by the following Formula (1). The invention further provides an invisible electrophotographic toner containing at least a binder resin and an infrared absorber, the infrared absorber containing at least a perimidine-squarylium dye represented by Formula (1). The invention further provides an electrophotographic developer containing at least the invisible electrophotographic toner. The invention further provides a toner cartridge containing at least the invisible electrophotographic toner. The invention further provides a process cartridge equipped with at least a developer holder and having at least the electrophotographic developer. The invention further provides an image forming apparatus having at least a developing unit which develops an electrostatic latent image with the electrophotographic developer to form a toner image.

(I)

21 Claims, 4 Drawing Sheets

U.S. PATENT DOCUMENTS

| | | | |
|---|---|---|---|
| 5,849,456 | A | 12/1998 | Matsumura et al. |
| 5,959,105 | A | 9/1999 | Harada et al. |
| 6,076,738 | A | 6/2000 | Bloomberg et al. |
| 2003/0175608 | A1 | 9/2003 | Takagi et al. |
| 2003/0232999 | A1 | 12/2003 | Sasaki et al. |
| 2005/0147912 | A1 | 7/2005 | Takagi et al. |
| 2007/0158420 | A1 | 7/2007 | Sonoda et al. |

FOREIGN PATENT DOCUMENTS

| | | |
|---|---|---|
| JP | A-6-250439 | 9/1994 |
| JP | A-7-53945 | 2/1995 |
| JP | A-7-271081 | 10/1995 |
| JP | B2-2547016 | 10/1996 |
| JP | A-9-77507 | 3/1997 |
| JP | A-9-104857 | 4/1997 |
| JP | A-10-204310 | 8/1998 |
| JP | B2-3141783 | 3/2001 |
| JP | A-2001-265181 | 9/2001 |
| JP | A-2001-294785 | 10/2001 |
| JP | A-2002-146254 | 5/2002 |
| JP | A-2002-164254 | 6/2002 |
| JP | A-2003-186238 | 7/2003 |
| JP | A-2004-59581 | 2/2004 |
| JP | B2-3590707 | 11/2004 |
| JP | A-2005-537319 | 12/2005 |
| JP | A-2007-179111 | 7/2007 |

ELECTROPHOTOGRAPHIC TONER, INVISIBLE ELECTROPHOTOGRAPHIC TONER, ELECTROPHOTOGRAPHIC DEVELOPER, TONER CARTRIDGE, PROCESS CARTRIDGE, AND IMAGE FORMATION APPARATUS

CROSS-REFERENCE TO RELATED APPLICATION

This application is based on and claims priority under 35 USC 119 from Japanese Patent Application No. 2009-029627 filed on Feb. 12, 2009.

BACKGROUND

1. Technical Field

The present invention relates to an electrophotographic toner, an invisible electrophotographic toner, an electrophotographic developer, a toner cartridge, a process cartridge, and an image formation apparatus.

2. Related Art

There has been known a technique of embedding information in a document by forming a pattern which is difficult to be recognized by the naked eye and which is invisible in this sense. Infrared absorption has been used for reading out this pattern.

SUMMARY

One aspect of the invention is an electrophotographic toner comprising a binder resin and an infrared absorber, the infrared absorber comprising a perimidine-squarylium dye represented by the following Formula (1).

(I)

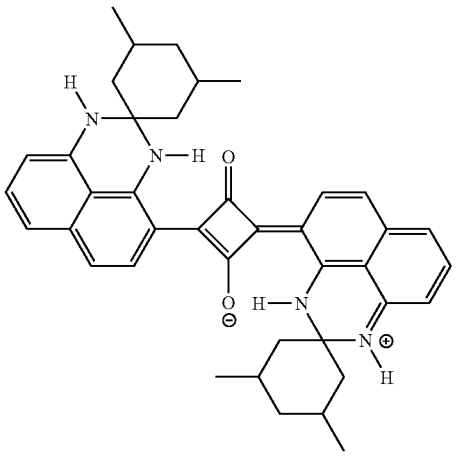

Another aspect of the invention is an invisible electrophotographic toner comprising a binder resin and an infrared absorber, the infrared absorber comprising a perimidine-squarylium dye represented by the following Formula (1).

(I)

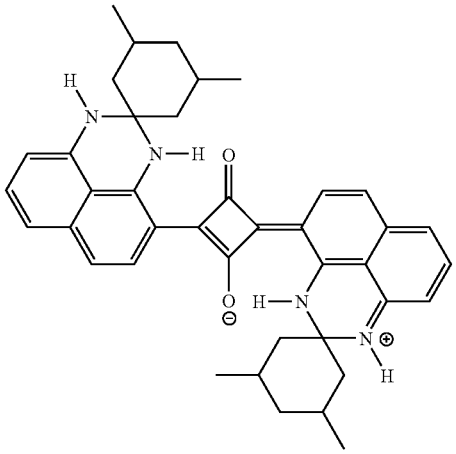

Another aspect of the invention is an electrophotographic developer comprising the invisible electrophotographic toner Another aspect of the invention is a toner cartridge comprising the invisible electrophotographic toner.

Another aspect of the invention is a process cartridge equipped with at least a developer holder and comprising the electrophotographic developer.

Another aspect of the invention is an image forming apparatus comprising:

an image holder;

a charging unit which charges the surface of the image holder;

an electrostatic latent image forming unit which forms an electrostatic latent image on the surface of the image holder charged by the electrostatic latent image forming unit;

a developing unit which develops the electrostatic latent image formed on the surface of the image holder with the electrophotographic developer to form a toner image;

a transferring unit which transfers the toner image formed on the surface of the image holder to a surface of a receiver; and a fixing unit which fixes the transferred image transferred on the surface of the receiver.

BRIEF DESCRIPTION OF THE DRAWINGS

Exemplary embodiments of the present invention will be described in detail based on the following figures, wherein.

DETAILED DESCRIPTION

Electrophotographic Toner

Figure 1:
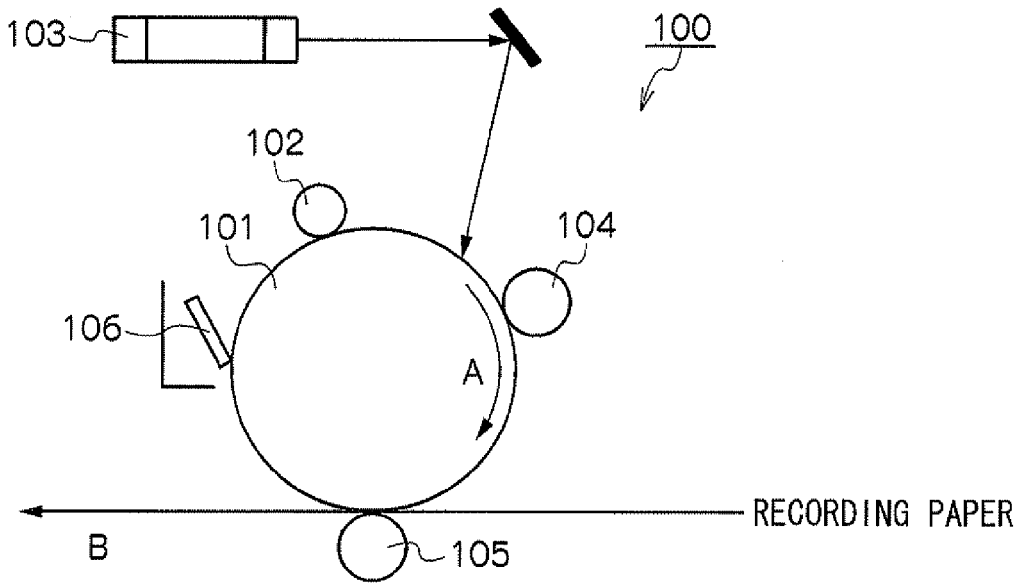
FIG. 1 is a schematic view illustrating an example of an image forming apparatus according to an exemplary embodiment of the invention.

The electrophotographic toner of one exemplary embodiment of one aspect of the invention, which may hereinafter be referred to as "the toner of the exemplary embodiment", contains a binder resin and an infrared absorber. The infrared absorber contains at least a perimidine-squarylium dye represented by the following Formula (1).

(I)

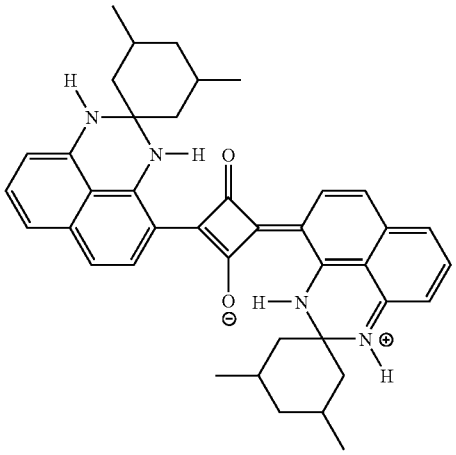

In embodiments, the perimidine-squarylium dye represented by Formula (1) is a crystalline particle which exhibits diffraction peaks at Bragg angles (2θ±0.2 degrees) of about 9.9°, about 13.2°, about 19.9°, about 20.8° and about 23.0° in a powder X-ray diffraction spectrum observed by irradiation with an X-ray having a wavelength of about 1.5405 Å using Cu as a target.

In embodiments, the perimidine-squarylium dye represented by Formula (1) has a median diameter (D50) of from about 80 nm to about 200 nm, a 16%-volume particle diameter of about 40 nm or more, and an 84%-volume particle diameter of about 300 nm or less.

If the median diameter D50 is less than about 80 nm, a large number of fine particles may lead to increase in aggregation force between particles, so that aggregation may tend to occur during granulation to form a toner and, as a result, the absorption of infrared rays may decrease due to increase in the diameter of dispersed particles of the dye in the toner.

If the median diameter (D50) exceeds about 200 nm, the amount of light scattered from the surface of the dye may increase, so that the infrared color exhibiting property of the dye may decrease. The median diameter (D50) is preferably about 80 nm to about 200 nm, and more preferably about 100 nm to about 150 nm.

If the 16%-volume particle diameter is less than about 40 nm, a large number of fine particles may lead to increase in aggregation force between particles, so that aggregation may tend to occur during granulation to form a toner and, as a result, the absorption of infrared rays may decrease due to increase in the diameter of dispersed particles of the dye in the toner. The 16%-volume particle diameter is preferably about 50 nm or more, and more preferably about 60 nm or more.

If the 84%-volume particle diameter exceeds about 300 nm, the amount of light scattered from the surface of particles increase, so that the infrared color exhibiting property of the dye may decrease. The 84%-volume particle diameter is preferably about 300 nm or less, and more preferably about 250 nm or less.

The perimidine-squarylium dye represented by Formula (1) can be obtained, for example, in accordance with the following reaction scheme.

(A-1)

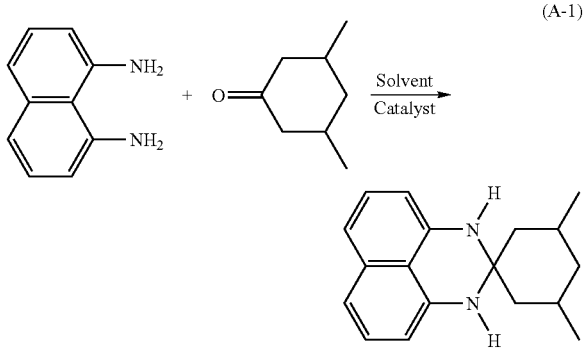

(a)

(A-2)

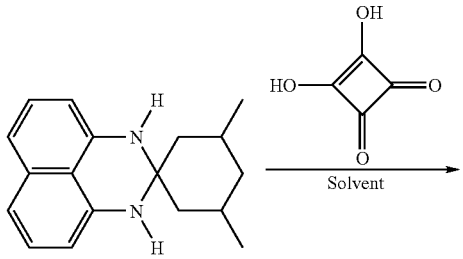

(a)

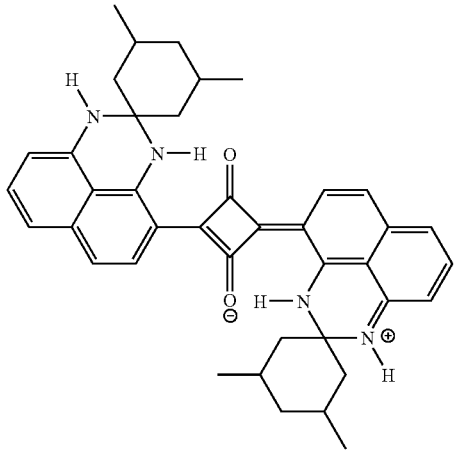

(I)

More specifically, a perimidine intermediate (a) can be obtained by reacting 1,8-diaminonaphthalene with 3,5-dimethylcyclohexanone in a solvent under azeotropic reflux condition in the presence of a catalyst (process (A-1)).

Examples of the catalyst to be used in the process (A-1) include p-toluenesulfonic acid monohydrate, benzenesulfonic acid monohydrate, 4-chlorobenzenesulfonic acid hydrate, pyridine-3-sulfonic acid, ethanesulfonic acid, sulfuric acid, nitric acid and acetic acid. Examples of the solvent to be used for the process (A-1) include alcohols and aromatic hydrocarbons. The perimidine intermediate (a) may be purified by high performance column chromatography or recrystallization.

Subsequently, the perimidine intermediate (a) can be reacted with 3,4-dihydroxycyclobut-3-ene-1,2-dione, which is also called "squaric acid", in a solvent under azeotropic reflux condition to provide the perimidine-squarylium dye represented by Formula (1) (process (A-2)). In embodiments, the process (A-2) may be performed in a nitrogen gas atmosphere.

Examples of the solvent to be used for the process (A-2) include alcohols such as 1-propanol, 1-butanol or 1-pentanol, aromatic hydrocarbons such as benzene, toluene, xylene or monochlorobenzene, ethers such as tetrahydrofuran or dioxane, halogenated hydrocarbons such as chloroform, dichloroethane, trichloroethane or dichloropropane, and amides such as N,N-dimethylformamide or N,N-dimethylacetamide. An alcohol may be used alone. In embodiments, solvents such as aromatic hydrocarbons, ethers, halogenated hydrocarbons or amides may be used in combination with an alcohol solvent as a mixture solvent. Specific examples of the solvent include 1-propanol, 2-propanol, 1-butanol, 2-butanol, a mixture solvent containing 1-propanol and benzene, a mixture solvent containing 1-propanol and toluene, a mixture solvent containing 1-propanol and N,N-dimethylformamide, a mixture solvent containing 2-propanol and benzene, a mixture solvent containing 2-propanol and toluene, a mixture solvent containing 2-propanol and N,N-dimethylformamide, a mixture solvent containing 1-butanol and benzene, a mixture solvent containing 1-butanol and toluene, a mixture solvent containing 1-butanol and N,N-dimethylformamide, a mixture solvent containing 2-butanol and benzene, a mixture solvent containing 2-butanol and toluene, and a mixed solvent 2-butanol of and N,N-dimethylformamide. When a mixed solvent is used, the concentration of an alcohol in the mixed solvent is preferably 1% by volume or more, and particularly preferably 5% by volume to 75% by volume.

In the process (A-2), the molar ratio of the perimidine intermediate (a) to 3,4-dihydroxycyclobut-3-ene-1,2-dione (i.e., the molar number of the perimidine intermediate (a) relative to the molar number of 3,4-dihydroxycyclobut-3-ene-1,2-dione) is preferably in the range of from 1 to 4, and more preferably in the range of from 1.5 to 3. If the molar ratio is less than 1, the yield of the perimidine-squarylium dye represented by Formula (1) may decrease. If the molar ratio exceeds 4, the utilization efficiency of the perimidine intermediate (a) lowers, which may lead difficulty in performing separation/purification of the perimidine-squarylium dye represented by Formula (1).

In the process (A-2), use of a dehydrating agent shortens the reaction time, and the yield of the perimidine-squarylium dye represented by Formula (1) tends to increase. The dehydrating agent is not particularly restricted as long as the perimidine intermediate (a) does not react with 3,4-dihydroxycyclobut-3-ene-1,2-dione. Specific examples of the dehydrating agent include orthoformates such as trimethyl orthoformate, triethyl orthoformate, tripropyl orthoformate or tributyl orthoformate, and molecular sieve.

Although the reaction temperature in the process (A-2) varies depending upon the kind of the solvent to be used, the temperature of the reaction liquid is preferably 60° C. or more, and particularly preferably 75° C. or more. In embodiments, when a mixture solvent containing 1-butanol and toluene is used, the temperature of the reaction liquid may be in the range of from 75° C. to 105° C.

The reaction time in the process (A-2) varies depending upon the kind of the solvent or the temperature of the reaction liquid. In embodiments, when a reaction is performed by using a mixture solvent containing 1-butanol and toluene and adjusting the temperature of the reaction liquid at 90° C. to 105° C., the reaction time may be 2 hours to 4 hours.

The perimidine-squarylium dye represented by Formula (1) generated in the process (A-2) may be purified by washing with a solvent, high-performance column chromatography or recrystallization.

In embodiments, the toner of the exemplary embodiment of the invention contains the perimidine-squarylium dye represented by Formula (1) which is in the form of particles.

Particles of the perimidine-squarylium dye represented by Formula (1) can be obtained by, for example, dissolving a purified material obtained from the process (A-2) in tetrahydrofuran, pouring the resulting solution into ice-cooled distilled water with an injector or the like under stirring to form a precipitate, collecting the precipitate by suction filtration, washing the resultant with distilled water, and then vacuum drying the resultant. Herein, the particle diameter of the precipitate to be obtained may be made to fall within a desired range by adjusting the concentration of the perimidine-squarylium dye represented by Formula (1) in the solution, the rate of pouring the solution, the quantity or temperature of distilled water, the stirring speed, and the like.

When the precipitate is secondarily aggregated, it may be converted into particles which are most suitable for toners by loosening secondary aggregation thereof with a known milling device such as a bead mill or a ball mill.

The toner of the exemplary embodiment may further contain ingredients other than the perimidine-squarylium dye represented by Formula (1). The content of the perimidine-squarylium dye represented by Formula (1) is preferably from about 0.5% by weight to about 2% by weight, and more preferably from about 0.7% by weight to about 1.5% by weight with respect to the total amount of the toner. When the content of the perimidine-squarylium dye represented by Formula (1) is less than about 0.3% by weight, the near-infrared absorptivity may be insufficient. When the content is more than the about 3% by weight, a color tone of an images formed with the toner may become yellowish, and the invisibility of an image formed with an invisible toner which uses the toner of the exemplary embodiment of the invention may be impaired.

The perimidine-squarylium dye represented by Formula (1) has sufficiently high absorbance for lights in a near-infrared wavelength region of 750 nm to 1000 nm and, on the other hand, has absorbance for lights in a visible wavelength region of 400 nm to 750 nm which is sufficiently low from the viewpoint of invisibility of information. Therefore, the toner of the exemplary embodiment containing the perimidine-squarylium dye represented by Formula (1) may be suitably used as an invisible toner.

Any binder resin which has conventionally been used for toners may be used as the binder resin contained in the toner of the exemplary embodiment without any particular limitations. Specific examples of the binder resin includes styrenes such as styrene, parachlorostyrene or α-methylstyrene, acrylic monomers such as methyl acrylate, ethyl acrylate, n-propyl acrylate, lauryl acrylate or 2-ethylhexyl acrylate, methacrylic monomers such as methyl methacrylate, ethyl methacrylate, n-propyl methacrylate, lauryl methacrylate or 2-ethylhexyl methacrylate, ethylenically unsaturated monomers such as acrylic acid, methacrylic acid or sodium styrenesulfonate, vinylnitriles such as acrylonitrile or methacrylonitrile, vinylethers such as vinyl methyl ether or vinyl isobutyl ether, vinylketones such as vinyl methyl ketone, vinyl ethyl ketone or vinyl isopropenyl ketone, homopolymers of monomers such as olefin (e.g., ethylene, propylene, butadiene), copolymers of two or more of these monomers, mixtures of any of these, nonvinyl condensed resins such as epoxy resin, polyester resin, polyurethane resin, polyamide resin, cellulose resin or polyether resin, mixtures thereof with the vinyl resins, and graft polymers obtained by polymerization of vinyl monomers in the presence of any one or more of these.

Examples of the binder resin further include polyester resins. Polyester resins have increasingly been used instead of styrene-acrylic resins in order to impart low-temperature fixability or image strength in formations of toners including aggregate-coalescing of particles of a resin or pigment in water or in the field which is called chemical toner. In embodiments, a polyester resin employed herein may be one that is primarily obtained by condensation polymerization of a polycarboxylic acid and a polyhydric alcohol. A non-crystalline polyester resin can be easily prepared into a resin particle dispersion liquid by emulsion-dispersing it by adjusting the acid value of the resin, by the use of an ionic surfactant and/or the like.

Example of the polycarboxylic acid include aromatic carboxylic acids such as terephthalic acid, isophthalic acid, phthalic anhydride, trimellitic anhydride, pyromellitic acid or naphthalene dicarboxylic acid, aliphatic carboxylic acids such as maleic anhydride, fimaric acid, succinic acid, alkenyl succinic anhydride or adipic acid, and alicyclic carboxylic acids such as cyclohexane dicarboxylic acid. In embodiments, aromatic carboxylic acids may be specifically used among these polycarboxylic acids. In embodiments, in view of forming a crosslinked structure or a branched structure for the purpose of securing fixability, a tri- or more-functional carboxylic acid (e.g., trimellitic acid or its anhydride) may be used in combination with a dicarboxylic acid. These polycarboxylic acids may be used alone or in combination of two or more thereof.

Example of the polyhydric alcohols include aliphatic diols such as ethylene glycol, diethylene glycol, triethylene glycol, propylene glycol, butanediol, hexanediol, neopentyl glycol, or glycerol, alicyclic diols such as cyclohexanediol, cyclohexanedimethanol or hydrogenated bisphenol A, and aromatic diols such as ethyleneoxide adducts of bisphenol A and propylene oxide adducts of bisphenol A. Among these polyhydric alcohols, aromatic diols and alicyclic diols are preferable, and aromatic diols are more preferable.

In view of forming a crosslinked structure or a branched structure for the purpose of securing good fixability, a tri- or more-hydric alcohol (e.g., glycerol, trimethylolpropane, pentaerythritol) may be used together with a diol. These polyhydric alcohols may be used alone or in combination of two or more thereof.

An acid value of the polyester resin obtained by polycondensation of a polycarboxylic acid and a polyhydric alcohol may be adjusted by adding a monocarboxylic acid and/or a monoalcohol to the polyester resin to esterify a hydroxyl group and/or a carboxylic group located at polymer terminals thereof.

Examples of the monocarboxylic acid include acetic acid, acetic anhydride, benzoic acid, trichloroacetic acid, trifluoroacetic acid and propionic anhydride. Examples of the monoalcohol include methanol, ethanol, propanol, octanol, 2-ethylhexanol, trifluoroethanol, trichloroethanol, hexafluoroisopropanol and phenol.

The toner of the exemplary embodiment may further contain a release agent such as a release agent resin. The release agent may be incorporated into the toner by being added as part of the binder resin component. Examples of the release agent include low molecular polyolefins such as polyethylene, polypropylene or polybutene, silicones, aliphatic acid amides such as oleic acid amide, erucic acid amide, ricinoleic acid amide or stearic acid amide, vegetable waxes such as carnauba wax, rice wax, candelilla wax, Japan wax or jojoba oil, animal waxes such as beeswax, mineral- or petroleum-waxes such as montan wax, ozokerite, ceresin wax, paraffin wax, microcrystalline wax or Fischer-Tropsch wax, and products formed by modifying thereof. In embodiments, at least one member selected from among these may be incorporated into particles of the toner of the exemplary embodiment.

The content of the at least one release agent is preferably in the range of from about 1% by weight to about 15% by weight, and more preferably in the range of from about 3% by weight to about 12% by weight, with respect to the total amount of the electrophotographic toner of the exemplary embodiment. When two or more kinds of the release agent are used together, the sum of the contents of the two or more of the release agent is preferably within the above ranges. If the total content of the release agent is less than about 1% by weight, a sufficient fixing latitude (temperature range of a fixing roll in which a toner may be fixed without causing offset of a toner) may not be obtained. On the other hand, if the total content of the release agent is more than about 15% by weight, uneven dispersing of the near-infrared absorptive material may occur. Moreover, the powder fluidity of the toner may decreases, which may result in adherence of a free release agent to the surface of a photoreceptor on which an electrostatic latent image is to be formed to disturb accurate formation of an electrostatic latent image.

The toner of the exemplary embodiment may, as necessary, contain various static controllers such as quaternary ammonium salts, boron-containing compound and zinc salicylate, as an internal additive. In embodiments, when the toner of the exemplary embodiment is used as an invisible toner, it may contain a charge controller which exhibits little absorption in the visible region.

The toner of the exemplary embodiment may further contain a colorant having a color other than black in addition to the perimidine-squarylium dye represented by Formula (1). The colorant of another color may be a known colorant. Examples of such colorants include various pigments such as carbon black, chrome yellow, Hansa yellow, benzidine yellow, threne yellow, quinoline yellow, permanent orange GTR, pyrazolone orange, vulcan orange, Watchung red, permanent red, brilliant carmine 3B, brilliant carmine 6B, Du pont oil red, pyrazolone red, lithol red, rhodamine B lake, lake red C, rose bengale, aniline blue, ultramarine blue, chalcoilblue, methylene blue chloride, phthalocyanine blue, phthalocyanine green or malachite green oxalate, and various dyes such as acridine dye, xanthene dye, azo dye, benzoquinone dye, azine dye, anthraquinone dye, thioindigo dye, dioxazine dye, thiazine dye, azomethine dye, indigo dye, thioindigo dye, phthalocyanine dye, aniline black dye, polymethine dye, triphenylmethane dye, diphenylmethane dye, thiazine dye, thiazole dye or xanthene dye. One or a combination of two or more of these may be used in the toner.

The toner may contain one or a combination of two or more of an inorganic powder(s) and/or a resin powder(s) as an external additive to its toner base material in view of improving long-term preservability, fluidity, developability, transferability and cleaning property.

Examples of the inorganic powder include silica, alumina, titania, zinc oxide and cerium oxide. Examples of the resin powder include spherical particles of PMMA, nylon, melamine, benzoguanamine or a fluorine-containing material and undefined shape powders of vinylidene chloride or fatty acid metal salts. The amount of such additives is preferably in the range of 0.5% by weight to 10% by weight, and more preferably in the range of 2% by weight to 8% by weight with respect to the total amount of the particle the toner of the exemplary embodiment.

Any known method can be used for producing the toner of the exemplary embodiment. The toner may be prepared by, for example, a knead-grinding method which includes: meltkneading a thermoplastic resin with a pigment, a static controller, and a release agent such as wax; cooling the mixture; finely grinding (crushing) the mixture; and then classifying the resulting particles. Inorganic particles or organic particles may be added to the surface of the toner particles as necessary in view of improving the fluidity or cleaning property.

The kneading may be carried out using any of various heat kneaders. Examples of the heat kneader include a three-roll kneader, single-shaft screw kneader, double-shat screw kneader and Banbury mixer kneader.

The finely grinding/crushing may be performed by using, for example, a MICRONIZER, ULMAX, JET-O-MIZER, KTM (Cripton), TURBOMIE Jet (the above names are all trade names) or the like. The method for producing the toner of the exemplary embodiment may further include a post treatment. Examples of the post treatment include applying, to the ground/crushed material, mechanical external force using a HYBRIDIZATION SYSTEM (manufactured by Nara Machinery Co., Ltd.), MECHANO-FUSION SYSTEM (manufactured by Hosokawamicron Corporation), CRIPTRON SYSTEM (manufactured by Kawasaki Heavy Industries Ltd.) (the above names are all trade names) or the like, to thereby change the shape of the ground/crushed material. Examples of the post treatment include further include applying hot air to make the toner particle being spherical. Examples of the post treatment include further include classifying the toner particles to control the size distribution of the toner The toner of the exemplary embodiment may also be produced by a so-called polymerization method, which is typified by emulsion aggregation method using emulsified particles. In particular, emulsion polymerization aggregation methods such as those shown in Japanese Patent Application Publication (JP-B) No. 2547016 or JP-A No. 6-250439 have been recently proposed as a method for intentionally controlling the shape or surface structure of a toner. Since the emulsion polymerization aggregation method uses, as a starting material, a raw material which has been granulated to have a diameter of 1 μm or smaller in general, it may principally efficiently provide a toner with a small diameter. In this production method, a resin dispersion liquid is prepared generally by emulsion polymerization or the like. On the other hand, a coloring agent dispersion liquid in which a coloring agent has been dispersed in a solvent is prepared. The resin dispersion liquid and the coloring agent dispersion liquid are mixed to form aggregated particles having a size which is as large as a diameter of an aimed toner particle. The aggregation particles are then heated to coalesce to result in a toner. It is difficult to intentionally control the formulation of a surface of the toner by this method because the surface of the toner formed by this method usually have the same formulation as that of the inside of the toner In view of addressing this matter, as shown in granted U.S. Pat. No. 3,141,783, it has been proposed approaches for realizing precise control through performing freely-conductive control to form a surface layer starting from an inside layer of a toner particle even for those formed by the emulsion polymerization aggregation method.

The shape factor SF1 of the toner of the exemplary embodiment is preferably in the range of from about 120 to about 140, and more preferably in the range of from about 125 to about 135 in view of achieving excellent image reproducibility of a minute invisible code as small as about 100 μm×100 μm and improving the cleaning performance with a blade.

The shape factor SF1 may be calculated as follows. An optical micrograph of a toner scattered on a slide glass is imported to a LUZEX image analyzer through a video camera, and the maximum length (ML) and the projected area (A) are measured for 50 or more toner particles. A value obtained by dividing the square of the measured perimeter by the measured projected area ($ML^2/A$) is taken as the shape factor SF1 of the toner The median diameter of the toner of the exemplary embodiment is preferably in the range of from about 3 μm to about 10 μm, and more preferably in the range of from about 5 μm to about 8 μm. When the median diameter is smaller than about 3 μm, the electrostatic adhesion force of toner particles becomes larger than the gravity and, as a result, it may become difficult to handle the toner as a powder. On the other hand, when the median diameter is larger than about 10 μm, an image formed from the toner may come to have large surface unevenness. In particular, when the image is embedded under a normal image, the surface unevenness may affect a normal image (an image which locates on the surface to be observed) and, as a result, it may become difficult to reproduce a highly precise color image.

The reflectance of a fixed image formed from the toner of the exemplary embodiment at about 450 nm is preferably about 0.7 or more, and is more preferably in the range of from about 0.8 to about 0.95. Generally, recycled paper (for example, trade name: GREEN 100 PAPER, manufactured by Fuji Xerox Office Supply Co., Ltd.) has a reflectance at 450 nm of 0.7; plain paper (for example, trade name: J PAPER, manufactured by Fuji Xerox Office Supply Co., Ltd.) has a reflectance at 450 nm of 0.88; and coated paper (for example, trade name: JD COATED PAPER, manufactured by Fuji Xerox Office Supply Co., Ltd.) has a reflectance at 450 nm of 0.82. Therefore, a fixed image may satisfy the requirement with respect to invisibility when it has a reflectance at about 450 nm of about 0.7 or more. In embodiments, the reflectance at 450 nm of a fixed image formed from an invisible toner provided as an exemplary embodiment of the invention may be adjusted by regulating the content of an infrared absorber in the invisible toner depending upon the reflectance of a material on which the image is to be fixed.

A value obtained by using a spectrophotometer U-4000 (trade name, manufactured by Hitachi, Ltd.) is adopted as the reflectance in the exemplary embodiment. The measurement may be performed by using a 2 cm×2 cm image of an invisible toner as a sample.

Electrophotographic Developer

The electrophotographic developer of an exemplary embodiment of the invention contains at least the toner of the exemplary embodiment. The toner of the exemplary embodiment may be formulated into a one-component developer containing the toner as it is or also may be formulated into a two-component developer containing the toner in combination with a known carrier. In embodiments, the developer of the exemplary embodiment for electrophotography may be a two-component developer.

When the developer of the exemplary embodiment for electrophotography is a two-component developer, it may be obtained by mixing a carrier and the toner of the exemplary embodiment by a known technique.

A two-component developer containing the toner of the exemplary embodiment of the invention is hereinafter exemplified for explaining the developer of the exemplary embodiment.

The toner concentration (TC) of the invisible toner in the developer is preferably in a range from 3% by weight to 15% by weight and more preferably in a range from 5% by weight to 12% by weight. The toner concentration of the invisible toner is represented by the following equation.

$$TC\ (wt\ \%)=\{\text{Weight of the invisible toner contained in the developer (g)}/\text{Total weight of the developer (g)}\}\times 100$$

When the charge amount of the invisible toner at the mixing of the invisible toner with the carrier to form the developer is too large, the adhesion of the toner to the carrier may become excessively high to cause a phenomenon that the invisible toner may not be developed. On the other hand, when the charge amount is excessively small, the adhesion of the toner to the carrier may be insufficient to lead toner cloud caused by a free toner, which may cause fogging at forming of an image to affect readout of the image.

Therefore, the charge amount of the invisible toner in the developer is preferably in the range of from about 205 μC/g to about 80 μC/g, and more preferably in a range of from about 30 μC/g to about 40 μC/g as absolute value in view of accomplishing better developing.

There are no particular restrictions on the carrier. Any known carriers may be used. Examples of the carrier include resin-coated carriers having a resin coating layer having a coating resin on a surface of a core. The carrier may be a resin dispersion carrier in which a conductive material or the like is dispersed in a matrix resin.

Examples of the coating resin and the matrix resin to be used as a carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin composed of an organosiloxane bond or modified products thereof, fluorocarbon resin, polyester, polycarbonate, phenol resin, and epoxy resin.

Examples of the conductive material include, but are not limited to, metals such as gold, silver or copper, titanium oxide, zinc oxide, barium sulfide, aluminum borate, potassium titanate and tin oxide.

Examples of the core of the carrier include magnetic oxides (such as ferrite or magnetite) and glass beads. In embodiments which employ a carrier in a magnetic brush developing method, the core of a carrier may be a magnetic material. The median diameter of the core of the carrier is preferably in the range of 10 μm to 500 μm, and more preferably in the range of 30 μm to 100 μm.

Examples of the method of coating the surface of the core of the carrier with resin include a method of coating the core with a coating layer forming solution in which a coating resin and, as needed, various additives have been dissolved in an appropriate solvent. The solvent is not particularly restricted and may be selected by taking into consideration the kind of the coating resin to be used, coatability, and the like.

Specific examples of the coating method include (1) a dipping method in which the core material of the carrier is dipped in a solution for forming a coating layer, (2) a spray method in which a solution for forming a coating layer is sprayed on the surface of the core material of the carrier, (3) a fluidized bed method in which a solution for forming a coating layer is sprayed with the core material of the carrier which is floting by being suspended with flowing air, and (4) a kneader coater method in which the core material of the carrier is mixed with a solution for forming a coating layer in a kneader coater, subsequently the solvent is removed.

The mixing ratio of the toner to the carrier (toner/carrier) in the developer containing the carrier preferably ranges from 1/100 to 30/100 and more preferably ranges from 3/100 to 20/100 in terms of weight.

Image Formation Method

One aspect of the invention is an image formation method which employs the toner of the exemplary embodiment. An exemplary embodiment of the image formation method includes at least one selected from the group consisting of: a) forming only an invisible image on the surface of an image output medium; (b) forming an invisible image and a visible image by dispoing these images one by one on the surface of the image output medium; and (c) forming an invisible image and a visible image separately in different regions on the surface of the image output medium, at least one of the invisible images formed by (a), (b) or (c) is composed of a two-dimensional pattern, and the invisible image is formed using the toner of the exemplary embodiment.

The term "invisible image" in the exemplary embodiment means an image which can be recognized by a reader such as a charge coupled device (CCD) in the infrared region, but cannot be recognized with the eye (namely, invisible) in the visible region because the invisible toner forming the invisible image has no color-exhibiting property caused by the absorption of a specific wavelength in the visible region.

The term "substantially invisible" in the exemplary embodiment means that an image which is created by the use of the code embedding method (in which the region where an image having a size 100 μm×100 μm or less is provided as an invisible code has an image area ratio of 10% or less) cannot be recognized by the naked eye and therefore may be considered as being invisible, even though an invisible toner which forms the invisible image exhibits color to a certain extent due to absorption of light having a specific wavelength within a visible light region.

The term "visible image" in the exemplary embodiment means an image which may not be recognized with a reader such as CCD in the infrared region but may be recognized by visual observation in the visible region (in other words, is visible) because a visible toner forming the visible image exhibits color due to absorption of light having a specific wavelength within the visible light region.

An invisible image provided via the image formation method of the exemplary embodiment is formed with the electrophotographic toner of the exemplary embodiment. Accordingly, the invisible image may enable to carry out mechanical reading and decrypting/decoding stably for a long period of time and to record information at high density. Also, because the invisible image has little color-developing ability in the visible region and is therefore invisible or substantially invisible, it can be formed in a desired region of an image-forming surface of image output medium irrelevant to whether or not a visible image is formed on the image-forming surface of the image output medium.

In embodiments, the invisible image may be formed of a toner which provides a visible image having an absorbance for light in a near-infrared wavelength region of 5% or less and has a color of yellow, magenta, or cyan.

A visible toner which may be employed to form a visible image in addition to the invisible image does not necessarily have a color a of yellow, magenta, or cyan, and can have a desired color such as red, blue or green. In embodiments, the visible toner has an absorbance for light in a near-infrared wavelength region of 5% or less regardless of its color.

When the near-infrared light absorbance of the visible toner exceeds 5%, there may be the case that a visible image is erroneously recognized as an invisible image in the case where an image forming surface of an image output medium has both an invisible image and the visible image formed thereon and is subjected to mechanical reading via infrared radiation. Particularly, when the image forming surface is subjected to mechanical reading without specifying the area where the invisible image is formed and when the invisible image is formed between the visible image and the surface of the image output medium, there may the case that it is difficult to read only the information of the invisible image perform decrypting/decoding correctly.

Typical examples of a colorant used to obtain the visible toner include aniline blue, chalcoil blue, chrome yellow, ultramarine blue, DU POND OIL RED, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I. Pigment Blue 15:3.

The near-infrared light absorbance of the invisible toner forming an invisible image can be higher than that of the visible toner forming a visible image by preferably 15% or more and more preferably 30% or more in view of improving an accuracy in the reading of the invisible image.

The near-infrared light absorbance is determined by the following equation from a reflectance measured by using an analyzer U-4000 (described above). In the exemplary embodiment, a visible- or invisible-toner images having a size of 2 cm×2 cm are employed as samples to be subjected to the measurement.

$$\text{Near-infrared light absorbance at 850 nm (\%)} = 100 - [\text{reflectance at 850 nm}](\%)$$

If a difference between the near-infrared light absorbance of an invisible image and that of a visible image is less than 15%, then upon performing mechanical reading in the region between the near-infrared light absorbance of the invisible image and that of the visible image, by binary-coding using a specific contrast (threshold value) as a boundary in order to read the invisible image by discriminating the invisible image from others, it may be difficult to recognize and read only the invisible image. That is, a visible image may become a hindrance when reading an invisible image, and may further become a hindrance in correctly decoding information recorded in the invisible image in such a case.

Invisible Image

Next, a configuration of the invisible image to be formed by the image formation method of the exemplary embodiment, the recognition of the invisible image with the eye, the mechanical reading of the invisible image and the like will be explained in detail.

No particular limitation is imposed on the invisible image as far as it is formed using the electrophotographic toner of the exemplary embodiment and can be read by mechanical devices with near-infrared radiation. The invisible image may be formed of an image of characters, numerals, symbols, patterns, pictures and/or photographs, and may be a two-dimensional pattern such as a known bar code called as JAN, standard ITF, Code 128, Code 39, NW-7 or the like.

In embodiments, an infrared absorbent of the exemplary embodiment is employed in a method in which a code is formed to be a code pattern having a size of about 100 μm×100 μm and having the rate of its dot-containing area per a unit code area of 10% or less.

Similarly to the bar code, the two-dimensional pattern is not particularly limited as long as it is formed with any known recording system which has been used for forming visually-recognizable images.

Examples of a method of forming a two-dimensional pattern in which cells having a microscopic area are geometrically arranged is a method of forming a two-dimensional bar code called a QR code. Examples of a method of forming a two-dimensional pattern in which micro-line bit maps are geometrically arranged is a method of forming a code with plural patterns differing in the angle of rotation as described in JP-A No. 4-233683.

The formation of the invisible image composed of such a two-dimensional pattern on the surface of an image output medium may enable to embed large size information such as music information or electronic file of a document application soft in the image in the form which cannot be recognized with the naked eye so as to provide technologies for making higher level secret documents and/or documents having both digital information and analogue information in combination.

On the other hand, the visible image formed together with the invisible image by using the image formation method of the exemplary embodiment may be any image. Any known image formation method including an electrophotographic system may be used as the method of forming the visible image. In embodiments, the near-infrared light absorbance of the visible image is 5% or less in view of reading the invisible image using mechanical devices with high accuracy. No particular limitation is imposed on the image output medium used in the image formation method of the exemplary embodiment insofar as it allows formation of an image with the electrophotographic toner of the exemplary embodiment. In embodiments in which the invisible image is formed directly on the image output medium, those which do not absorb light having a wavelength in the near-infrared light region may be employed as the image output medium. In embodiments in which the invisible toner is produced by adding a white pigment such as a titania particle, those which are white or have high whiteness may be employed as the image output medium.

As described above, an invisible image composed of a two-dimensional pattern formed on the surface of an image output medium by the image formation method of the exemplary embodiment may be read in a wavelength range of about 780 nm or more. Namely, the invisible image may not be seen by the naked eye and may be read in the near-infrared light region by using specific devices. Examples of the specific reading devices include an image sensor sensitive to infrared light employed to read an image on a recording paper while the recording paper is irradiated with illumination having an infrared component.

Image Forming Apparatus, Toner Cartridge, and Process Cartridge

The image forming apparatus of the exemplary embodiment has at least: an image holder; a charging unit which charges the surface of the image holder; an electrostatic latent image forming unit which forms an electrostatic latent image on the surface of the image holder charged by the electrostatic latent image forming unit; a developing unit which develops the electrostatic latent image formed on the surface of the image holder with a developer to form a toner image; a transferring unit which transfers the toner image formed on the surface of the image holder to a surface of a receiver; and a fixing unit which fixes the transferred image transferred on the surface of the receiver, in which the developer is the electrophotographic developer of the exemplary embodiment.

The toner cartridge of the exemplary embodiment contains the toner of the exemplary embodiment.

The process cartridge of the exemplary embodiment has at least a developer holder and contains the developer of the exemplary embodiment for electrophotography.

The image forming apparatus of the exemplary embodiment will be explained as to an embodiment in which a invisible image is formed in detail with reference to the drawings. In the followings, an image forming apparatus for forming an invisible image by an electrophotographic method and an image forming apparatus for forming a visible image together with an invisible image at the same time by an electrophotographic method are given as exemplary embodiments of the image forming apparatus; however, the invention is not limited to these.

FIG. 1 is a schematic view showing an exemplary embodiment of the structure of an image forming apparatus for forming an invisible image by the image formation method of the exemplary embodiment. An image forming apparatus 100 shown in the figure is provided with image forming devices such as an image holder 101, a charger 102 (charging unit), an image writing device 103 (electrostatic latent image forming unit), a developing device 104 (developing unit), a transfer roll 105 (transferring unit) and a cleaning blade 106.

The image holder 101 is formed in a drum form as a whole and has a photosensitive layer on the outer periphery (drum surface) thereof. This image holder 101 is disposed such that it is rotatable in the direction of the arrow A. The charger 102 is used to charge the image holder 101 evenly. The image writing device 103 is used to form an electrostatic latent image by subjecting the image holder 101 charged evenly by the charger 102 to imagewise irradiation.

The developer 104 stores an invisible toner, supplies this invisible toner to the surface of the image holder 101 on which the electrostatic latent image is formed by the image writing device 103 and carries out developing to form a toner image on the surface of the image holder 101. The transfer roll 105 is used to transfer the toner image formed on the surface of the image holder 101 to a recording paper (image output medium) with sandwiching the recording paper carried in the direction of the arrow B by a paper carrying devices (not shown) between itself and the image holder 101. The cleaning blade 106 removes the electrophotographic toner left on the surface of the image holder 101 to clean the surface on the surface of the image holder 101 after the toner image is transferred.

Next, explanations will be furnished as to the formation of an invisible image by using the image forming apparatus 100. First, the image holder 101 is driven with rotation and the surface of the image holder 101 is evenly charged by the charger 102. Then, the charged surface is subjected to imagewise irradiation by the image writing device 103 to form an electrostatic latent image. Thereafter, a toner image is formed by the developing device 104 on the surface of the image holder 101 on which surface the electrostatic latent image is formed and then the toner image is transferred to the surface of a recording paper by the transfer roll 105. At this time, a toner left unremoved on the surface of the image holder 101 is removed by the cleaning blade 106. An invisible image expressing attached information and the like which are expected to be concealed visually is thus formed on the surface of the recording paper.

Herein, another image forming apparatus may be employed for further recording visible images such as characters, numerals, symbols, patterns, pictures or photographic images on the surface of the recording paper on which surface the invisible image is formed by the image forming apparatus 100. The method of recording this visible image may be arbitrarily selected from not only ordinary printing measures such as offset printing, relief-printing or intaglio printing, but also from known image forming technologies such as thermal transfer recording, an ink jet method or an electrophotographic method.

Here, in the case of using an electrophotographic method for forming the visible image, technologies superior in productivity and secret manageability can be provided by continuously performing formations of the invisible image and the visible image. Examples of the process flow of image formation in this case include a method which is generally called a tandem system, in which developers containing only an invisible toner, only a yellow toner, only a magenta toner, or only a cyan toner, are respectively stored in the developer 104 installed in the image forming apparatus 100 and recording images formed of respective developers onto the image output medium one after another in a superimposing manner is carried out.

As described above, in embodiments, an invisible image can be formed so as to be embedded between a visible image and a surface of a recording paper by forming the invisible image on the surface of the recording paper and then forming the visible image thereon by using the image forming apparatus shown in FIG. 1.

Figure 2:
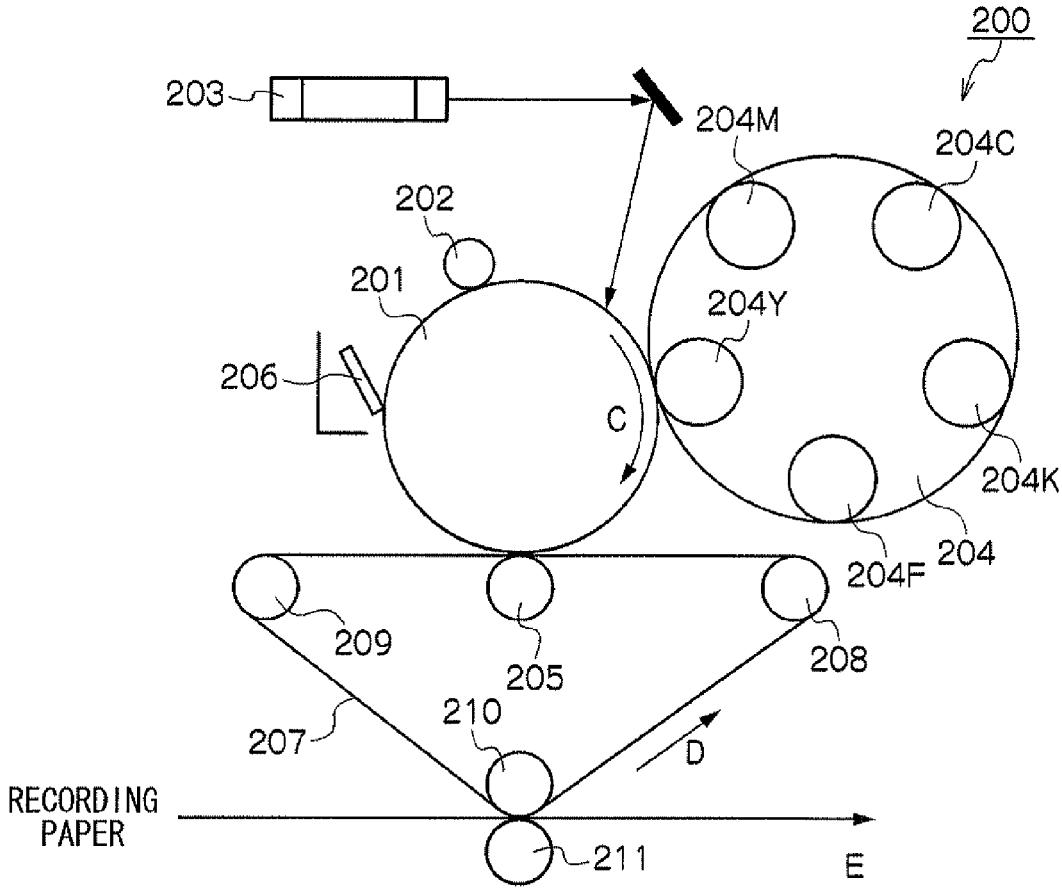
FIG. 2 is a schematic view illustrating an example of an image forming apparatus according to an exemplary embodiment of the invention.

FIG. 2 is a schematic view showing an exemplary embodiment of the structure of an image forming apparatus for a forming a visible image together with an invisible image at the same time by using the image formation method of the exemplary embodiment. An image forming apparatus 200 shown in the figure is structured such that it is provided with an image holder 201, a charger 202 (charging unit), an image writing device 203 (electrostatic latent image forming unit), a rotary developing device 204 (developing unit), a primary transfer roll 205 (primary transferring unit), a cleaning blade 206, an intermediate transfer body 207, plural (three in the figure) support rolls 208, 209 and 210, a secondary transfer roll 211 (secondary transferring unit) and the like.

The image holder 201 is formed in a drum form as a whole and has a photosensitive layer on the outer periphery (drum surface) thereof. This image holder 201 is disposed such that it is rotatable in the direction of the arrow C in the FIG. 2. The charger 202 is used to charge the image holder 201 evenly. The image writing device 203 is used to form an electrostatic image by subjecteing the image holder 201, evenly charged by the charger 202, to imagewise irradiation.

The rotary developing device 204 is provided with five developing devices 204Y, 204M, 204C, 204K and 204F which store a yellow toner, a magenta toner, a cyan toner, a black toner and an invisible toner respectively. Toners are used as developers for forming an image in this device. Accordingly, the yellow toner is stored in the developing device 204Y, the magenta toner is stored in the developing device 204M, the cyan toner is stored in the developing device 204C, the black toner is stored in the developing device 204K, and the invisible toner is stored in the developing device 204F respectively. This rotary developing device 204 forms a visible toner image and an invisible toner image by driving the five developing devices 204Y, 204M, 204C, 204K and 204F with rotation such that these units are made to be close and opposite to the image holder 201 one by one to transfer a toner to an electrostatic latent image corresponding to each color Here, any one or more of the developing devices other than the developing device 204F in the rotary developing device 204 may be omitted according to a visible image to be required. In embodiments, the rotary developing device can be composed of four developing devices 204Y, 204M, 204C and 204F. Also, in embodiments, the developing device for forming a visible image may be replaced by a developing device storing a developer having a desired color such as red, blue or green.

The primary transfer roll 205 is used to transfer (primary transfer) the toner image (the visible toner image or the invisible toner image) formed on the surface of the image holder 201 to the outer peripheral surface of the intermediate transfer body 207 having the form of an endless belt with disposing the intermediate transfer body 207 between itself and the image holder 201. The cleaning blade 206 is used to remove a toner left unremoved on the surface of the image holder 201 for cleaning the surface of the image holder 201 after the toner image is transferred. The intermediate transfer body 207 is supported such that it is rotatable in the direction of the arrow D and the reverse direction with its internal peripheral surface being hung by plural support rolls 208, 209 and 210. The secondary transfer roll 211 is used to transfer the toner image transferred to the outer peripheral surface of the intermediate transfer body 207 to a recording paper with disposing the recording paper (image output medium) carried in the direction of the arrow E by a paper carrying devices (not shown) between itself and the support roll 210.

The image forming apparatus 200 is used to form toner images one by one on the surface of the image holder 201 and to transfer the toner images on the outer peripheral surface of the intermediate transfer body 207 such that these toner images are overlapped with each other, and works as follows. First, the image holder 201 is driven with rotation and the surface of the image holder 201 is evenly charged by the charger 202. Then, the image holder 201 is subjected to imagewise irradiation by the image writing device 203 to form an electrostatic latent image. This electrostatic latent image is developed by the yellow developing device 204Y and then the toner image is transferred to the outer peripheral surface of the intermediate body 207 by the primary transfer roll 205. The yellow toner which is not transferred to the recording paper and left unremoved on the surface of the image holder 201 is removed by the cleaning blade 206 to clean the surface of the image holder 201. The intermediate transfer body 207 provided with the yellow toner image formed on the outer peripheral surface thereof is moved with rotation once to the reverse of the direction of the arrow D with retaining the yellow toner image on the outer peripheral surface thereof and set to the position where placement and transfer of the next magenta toner image on the yellow toner image are to be performed.

As to also each color of magenta, cyan and black, charging using the charger 202, imagewise irradiation by the image writing device 203, the formation of a toner image by using each of the developing devices 204M, 204C and 204K, and the transfer of the toner image to the outer peripheral surface of the intermediate transfer body 207 are afterwards repeated in this order.

After the transfer of four color toners to the outer peripheral surface of the intermediate transfer body 207 is finished, the surface of the image holder 201 is evenly charged again by the charger 202 in succession to the above process. Then, the surface of the image holder is subjected to imagewise irradiation from the image writing device 203 to form an electrostatic latent image. After the electrostatic latent image is developed by the developing device 204F for an invisible image, the obtained toner image is transferred to the outer peripheral surface of the intermediate transfer body 207 by the primary transfer roll 205. Both a full-color image (visible toner image), in which four color toner images are overlapped on each other, and an invisible toner image are thus formed on the outer peripheral surface of the intermediate transfer body 207. The full color visible toner image and the invisible toner image are transferred collectively to a recording paper by the secondary transfer roll 211. A recorded image in which the fill-color visible image and the invisible image are intermingled is obtained on the image forming surface of the recording paper. In the image formation method of the exemplary embodiment using the image forming apparatus 200, the invisible image is formed between the visible image and the surface of the recording paper in the region where the visible image and the invisible image are overlapped.

The image formation method of the invention using the image forming apparatus 200 shown in FIG. 2 may achieve performing both of the formation of a full-color visible image and the embedding of attached information by the formation of an invisible image on the surface of a recording paper at the same time, in addition to an effect similar to that obtained in the image formation using the image forming apparatus 100 shown in FIG. 1.

The resolution of the invisible image may be differed from that of the visible image when forming an image so that reading of the invisible image can be easier by efficiently separate the signals (data) caused by the invisible image from the noise signal caused by the visible image to easy the by, for example, performing, as data processing after reading the invisible image, filtering to cut frequency components which correspond to the resolution of the visible image. In this regard, the resolution of these images may be regulated by regulating the writing frequency of the electrostatic latent images in the image writing device 203.

EXAMPLES

Hereinafter, the present invention will be explained with reference to examples in details, but the invention is not limited to these examples. Unless otherwise specified, "part" means "parts by weight", and "percent (%)" means "percent by weight".

Example 1

Preparation of Infrared Absorber

Synthesis of ISQ10

Preparation of a Perimidine-Squarylium Dye: Two-Stage Synthesis

A mixture liquid containing 4.843 parts of 1,8-diaminonaphthalene (98%, 30.0 mmol), 3.886 parts of 3,5-dimethylcyclohexanone (98%, 30.2 mmol), 10 milliparts of p-toluenesulfonic acid monohydrate (0.053 mmol) and 45 parts of toluene is heated to reflux for 5 hours while being stirred in a nitrogen gas atmosphere. Water formed during the reaction is removed by azeotropic distillation. After completion of the reaction, a dark brown solid resulting from evaporation of toluene is extracted with acetone, purified by recrystallization from a mixture solvent containing acetone and ethanol, and then dried to afford 7.48 parts of brown solid (yield: 93.6%). The result of the analysis of the resultant brown solid by $^1$H-NMR spectrum ($CDCl_3$) is provided below.

$^1$H-NM spectrum ($CDCl_3$): δ=7.25, 7.23, 7.22, 7.20, 7.17, 7.15 (m, 4H, $H_{arom}$); 6.54 (d×d, $J_1$=23.05 Hz, $J_2$=7.19 Hz,2H, $H_{arom}$); 4.62 (brs,2H,2×NH); 2.11 (d,J=12.68 Hz,2H,$CH_2$); 1.75, 1.71, 1.70, 1.69, 1.67, 1.66 (m,3H,2×CH, CH2); 1.03 (t,J=12.68 Hz, 2H, $CH_2$); 0.89 (d,J=6.34 Hz, 6H, 2×$CH_3$); 0.63 (d,J=11.71 Hz, 1H, $CH_2$)

A mixture liquid containing 4.69 parts (17.6 mmol) of the brown solid, 0.913 parts (8.0 mmol) of 3,4-dihydroxycyclobut-3-ene-1,2-dione, 40 parts of n-butanol and 60 parts of toluene is heated to reflux and react for 3 hours while being stirred in a nitrogen gas atmosphere. Water formed during the reaction is removed by azeotropic distillation. After completion of the reaction, most of the solvent is evaporated into the nitrogen gas atmosphere and then 120 parts of hexane is added to the resulting reaction mixture under stirring. A resultant dark brown precipitate is collected by vacuum filtration, washed with hexane, and then dried to provide a dark blue solid. The solid is washed successively with ethanol, acetone, 60% aqueous ethanol solution, ethanol, and acetone to provide 4.30 parts (yield: 88%) of a desired compound (dark blue solid).

Milling Treatment of Infrared Absorber

A container for a ball mill is charged with 5 parts of the perimidine-squarylium dye obtained by the production method described above, 100 parts of tetrahydrofuran (THF) and 1000 parts of zirconia beads 1 mm in diameter, followed by milling treatment for 8 hours. Water is added to the container for a ball mill, followed by filtration through a 50 nm-mesh filter Thus, granulated perimidine-squarylium dye (hereinafter, referred to as "ISQ-10(A)") is collected. ISQ-10 (A) has about 145 nm of the median diameter D50, 35 nm of the 16%-volume particle diameter and 210 nm of the 84%-volume particle diameter. ISQ-10(A) is subjected to X-ray diffraction measurement using X-ray irradiation with an X-ray having a wavelength of $\lambda$=1.5405 Å with a Cu target by means of an X-ray diffraction analyzer (trade name: D8 DISCOVER, manufactured by Burker AXS, K.K.). In the resulting powder X-ray diffraction spectrum, ISQ-10(A) exhibits diffraction peaks, at least, at Bragg angles ($2\theta\pm0.2$ degrees) of 9.9°, 13.2°, 19.9°, 20.8°, and 23.0°. The measurement result of the powder X-ray diffraction shows that ISQ-10(A) has high crystallinity.

Preparation of Dispersion Liquid of Infrared Absorber

An infrared absorber dispersion liquid is prepared by subjecting 10 parts of the ISQ-10(A) obtained by the method described above to ultrasonic dispersion together with 2.5 parts of a surfactant and 100 parts of ion exchange water (ultrasonic power: 4 to 5 W; a ¼-inch phone is employed; irradiation time: 30 minutes). The concentration of ISQ-10 (A) in the infrared absorber dispersion liquid is 8.9%.

Preparation of Resin Particle Dispersion Liquid

A solution (420 parts) composed of 320 parts of styrene, 80 parts of n-butyl acrylate, 10 parts of acrylic acid and 10 parts of dodecanethiol, and a solution prepared by dissolving 6 parts of a nonionic surfactant (trade name: NONIPOL 400, manufactured by Sanyo Chemical Industries, Ltd.) and 10 parts of an anionic surfactant (trade name: NEOGEN®, manufactured by Daiichi Pharmaceutical Co., Ltd.) in 550 parts of ion exchange water are charged in a flask, dispersed and emulsified. Under slow stirring and mixing, 50 parts of ion exchange water containing 4 parts of ammonium persulfate dissolved is charged over 10 minutes. Then the atmosphere in the flask is fully replaced by nitrogen. Then heating is performed under stirring on an oil bath until the temperature in the system reaches 70° C. Subsequently, emulsion polymerization is continued for 5 hours to yield a resin particle dispersion liquid.

The median diameter (D50) of resin particles of the resin particle dispersion liquid (latex) measured with a laser diffraction particle size distribution analyzer (trade name: LA-700, manufactured by Horiba Ltd.) is 155 nm. The glass transition point of the resin measured at a temperature increase rate of 10° C./min by using a differential scanning calorimeter (DSC-50, manufactured by Shimadzu Corporation) is 54° C. The weight average molecular weight (polystyrene-equivalent) of the resin measured by using THF as a solvent and using a molecular weight analyzer (trade name: HLC-8020, manufactured by Tosoh Corporation) is 33000.

Preparation of Release Agent Particle Dispersion Liquid

Forty parts of paraffin wax (trade name: HNPO190, manufactured by Nippon Seiro Co., Ltd., melting point: 85° C.), 5 parts of a cationic surfactant (trade name: SANISOL B-50, manufactured by Kao Corporation) and 200 parts of ion exchange water are heated at 95° C., dispersed with a homogenizer (trade name: ULTRA-TURRAX T50, manufactured by IKA), and then subjected to dispersion treatment with a pressure discharge type homogenizer. Thus a release agent dispersion liquid which contains a dispersed release agent having an average particle diameter of 550 nm is prepared.

Preparation of Toner Particles

In a round, stainless steel flask, 260 parts of the resin particle dispersion liquid, 14 parts of the infrared absorber dispersion liquid, 70 parts of the release agent dispersion liquid and 1.5 parts of a cationic surfactant (SANISOL B-50, described above) are mixed and dispersed with a homogenizer (ULTRA-TURRAX T50, described above). Then the contents of the flask are heated to 48° C. while being stirred on an oil bath for heating. After holding the resultant at 48° C. for 30 minutes, observation with an optical microscope is performed to see that aggregated particles (95 $cm^3$ in volume) having an average particle diameter of about 5 μm is formed.

Then, 60 parts of a resin particle-containing dispersion liquid is slowly added thereto. The volume of the resin particles contained in the dispersion liquid is 25 $cm^3$. Then the temperature of the oil bath for heating is raised to 50° C. and held for 1 hour. Observation with an optical microscope reveals that attached particles having an average particle diameter of about 5.7 μm is formed.

Then 3 parts of an anionic surfactant (trade name: NEOGEN SC, manufactured by Dai-Ichi Kogyo Seiyaku Co., Ltd.) is added thereto, and the stainless steel flask is thereafter sealed. It is heated to 105° C. and held for 3 hours while stirring is continued by use of a magnetic seal. After subsequent cooling, the reaction product is collected by filtration, fully washed with ion exchange water, and then dried to provide a toner for the development of an electrostatic image.

The average particle diameter of the resulting toner for the development of an electrostatic image measured by using COULTER MULTISIZER (trade name, manufactured by Beckman Coulter, Inc.) is 5.8 μm. A volume GSD, which is a measure of volume size distribution, of the resulting toner is measured to be 1.24. 100 particles of the resulting toner are measured for the maximum length (ML) and the projected area (A) by using a LUZEX image analyzer (trade name: LUZEX III, manufactured by NIRECO Corporation), followed by calculation on the basis of the equation given below. The shape factors SF1 of the resulting toner are then averaged, so that the central shape factor thereof is 132.

$$SF1=(ML^2/A)\times(\pi/4)\times100$$

Observation of a cross section of the thus-obtained toner particle is performed by using a transmission electron microscope (TEM) at a magnification of about 30,000 to reveal that the median diameter D50 of the near-infrared absorbing material dispersed in this particle is 150 nm, the 16%-volume particle diameter thereof is 73 nm, and the 84%-volume particle diameter thereof is 250 nm.

Next, an invisible toner of Example 1 (toner 1) is obtained by externally adding 0.9 parts of rutile titania particles (average particle diameter: 25 nm) and 1.0 part of silica particles (average particle diameter: 40 nm) with a Henschel mixer to 100 parts of the particles obtained via the above process. The content of ISQ-10(A) in toner 1 is 1.0%.

A developer of Example 1 (developer 1) is obtained by subjecting 8 parts of toner 1 and 100 parts of a carrier to be used in a complex machine (trade name: DOCUCENTRE COLOR 6500, manufactured by Fuji Xerox Co. Ltd.) to mixing treatment by using a V blender.

Example 2

Toner 2 and developer 2 are prepared in the same manners as toner 1 and developer 1 of Example 1 respectively, except for changing the time length of the milling in a ball mill at the milling of an infrared absorber to 24 hours. Herein, ISQ-10 (A) after the pigment milling is the particle diameter of about 85 nm in median diameter D50, the 16%-volume particle diameter of 50 nm, and the 84%-volume particle diameter of 195 nm. ISQ-10(A) is subjected to X-ray diffraction measurement using X-ray irradiation with an X-ray having a wavelength of λ=1.5405 Å with a Cu target by means of an X-ray diffraction analyzer (trade name: D8 DISCOVER, described above). In the resulting powder X-ray diffraction spectrum, ISQ-10(A) exhibits diffraction peaks, at least, at Bragg angles (2θ±0.2 degrees) of 9.9°, 13.2°, 19.9°, 20.8°, and 23.0°. The measurement result of the powder X-ray diffraction shows that ISQ-10(A) has high crystallinity. The content of ISQ-10 (A) in toner 2 is 1.0%. A cross section of a toner particle obtained from this material is observed by using a TEM at a magnification of about 30,000 and, as a result, it reveals that the near-infrared absorbing material dispersed in this particle has the volume median diameter of 97 nm, the 16%-volume particle diameter of 60 nm, and the 84%-volume particle diameter of 210 nm.

Example 3

Toner 3 and developer 3 are prepared in the same manners as toner 1 and developer 1 of Example 1 respectively, except for changing the time length of the milling in a ball mill at the milling of an infrared absorber to 4 hours. Herein, ISQ-10(A) after the pigment milling is the particle diameter of about 185 nm in median diameter D50, the 6%-volume particle diameter of 95 nm, and the 84%-volume particle diameter of 230 nm. ISQ-10(A) is subjected to X-ray diffraction measurement using X-ray irradiation with an X-ray having a wavelength of λ=1.5405 Å with a Cu target by means of an X-ray diffraction analyzer (trade name: D8 DISCOVER, described above). In the resulting powder X-ray diffraction spectrum, ISQ-10(A) exhibits diffraction peaks, at least, at Bragg angles (2θ±0.2 degrees) of 9.9°, 13.2°, 19.9°, 20.8° and 23.0°. The measurement result of the powder X-ray diffraction shows that ISQ-10(A) has high crystallinity. The content of ISQ-10(A) in toner 3 is 1.0%. A cross section of a toner particle obtained from this material is observed by using a TEM at a magnification of about 30,000 and, as a result, it reveals that the near-infrared absorbing material dispersed in this particle has the volume median diameter of 195 nm, the 16%-volume particle diameter of 100 nm, and the 84%-volume particle diameter of 245 nm.

Example 4

Toner 4 and developer 4 are prepared in the same manners as toner 1 and developer 1 of Example 1 respectively, except for changing the time length of the milling in a ball mill at the milling of an infrared absorber to 48 hours. Herein, ISQ-10 (A) after the pigment milling is the particle diameter of about 55 nm in median diameter D50, the 16%-volume particle diameter of 23 nm, and the 84%-volume particle diameter of 230 μm. ISQ-10(A) is subjected to X-ray diffraction measurement using X-ray irradiation with an X-ray having a wavelength of λ=1.5405 Å with a Cu target by means of an X-ray diffraction analyzer (trade name: D8 DISCOVER, described above). In the resulting powder X-ray diffraction spectrum, ISQ-10(A) exhibits diffraction peaks, at least, at Bragg angles (2θ±0.2 degrees) of 9.9°, 13.2°, 19.9°, 20.8°, and 23.0°. The measurement result of the powder X-ray diffraction shows that ISQ-10(A) has high crystallinity. The content of ISQ-10 (A) in toner 4 is 1.0%. A cross section of a toner particle obtained from this material is observed by using a TEM at a magnification of about 30,000 and, as a result, it reveals that the near-infrared absorbing material dispersed in this particle has the volume median diameter of 230 nm, the 16%-volume particle diameter of 150 nm, and the 84%-volume particle diameter of 350 nm. It is noted that although the pigment dispersion subjected to the milling in Example 4 has the particle diameter which is smaller than that of Examples 1-3, the near-infrared absorbing material in the resulted toner 4 has the particle diameter which is larger than that of Examples 1-3 due to coagulation of particles.

Comparative Example 1

A perimidine-squarylium dye having the structure of a dihydroperimidine squarylium compound represented by the formula (2) shown in Japanese Patent No. 3590707 in which n is 0 and each substituent is $C_2H_5$ is prepared by the method disclosed in Japanese Patent No. 3590707. The preparation method is as follows. A mixture containing 15.8 parts of 1,8-diaminonaphthalene, 10.8 parts of diethyl ketone and 25 milliparts of p-toluenesulfonic acid monohydrate are heated on a steam bath for 5 hours while being stirred. The resultant is subjected to extraction with 1000 parts of ethyl acetate and 500 parts of saturated aqueous sodium bicarbonate solution, followed by evaporation of the solvent. Thus, 20 parts of 2,2-diethyl-2,3-dihydroperimidine is obtained.

A mixture of 5.4 parts of the 2,2-diethyl-2,3-dihydroperimidine, 1.14 parts of squarylic acid, 50 parts of n-butanol and 50 parts of toluene is heated at an external temperature of 130° C. for 5 hours. Twenty milliliter of methanol is added, and then crystals formed are collected by filtration. The resulting compound is purified by column chromatography using silica gel and chloroform.

Toner 5 and developer 5 are prepared in the same manners as toner 1 and developer 1 of Example 1 respectively, except for changing the perimidine-squarylium dye subjected to the milling in a ball mill at the milling of an infrared absorber to the resultant obtained from the compound of Japanese Patent No. 3590707. A cross section of a toner particle contained in toner 5 is observed by using a TEM at a magnification of about 30,000 and, as a result, it reveals that the near-infrared absorbing material dispersed in this particle has the volume median diameter of 115 nm, the 16%-volume particle diameter of 55 nm, and the 84%-volume particle diameter of 200 nm.

Comparative Example 2

The compound 12 disclosed in Japanese Patent No. 3590707, which is a dihydroperimidine squarylium compound represented by the formula (2) shown in Japanese Patent No. 3590707 in which n is 0, is prepared by the method disclosed in Japanese Patent No. 3590707. The preparation method is as follows.

A mixture containing 15.8 parts of 1,8-diaminonaphthalene, 15.4 parts of 4-tert-butylcyclohexanone and 25 milliparts of p-toluenesulfonic acid monohydrate are heated on a steam bath for 5 hours while being stirred. The resultant is subjected to extraction with 1000 parts of ethyl acetate and 500 parts of saturated aqueous sodium bicarbonate solution, followed by evaporation of the solvent. Thus, 26 parts of spiro[4-tert-butylcyclohexanone-1,2'(3'H)-perimidine] is obtained.

A mixture of 7.0 parts of the spiro[4-tert-butylcyclohexanone-1,2'(3'H)-perimidine], 1.14 parts of squarylic acid, 50 parts of n-butanol and 50 parts of toluene is heated at an external temperature of 130° C. for 5 hours. Twenty milliliter of methanol is added, and then crystals formed are collected by filtration. The resulting compound (compound (6)) is purified by column chromatography using silica gel and chloroform.

Toner 6 and developer 6 are prepared in the same manners as toner 1 and developer 1 of Example 1 respectively, except for changing the perimidine-squarylium dye subjected to the milling in a ball mill at the milling of an infrared absorber to the compound (6). A cross section of a toner particle contained in toner 6 is observed by using a TEM at a magnification of about 30,000 and, as a result, it reveals that the near-infrared absorbing material dispersed in this particle has the volume median diameter of 105 nm, the 16%-volume particle diameter of 50 nm, and the 84%-volume particle diameter of 175 nm.

Image Formation Using Image Forming Apparatus

Image formations are performed with developers 1 to 6 obtained in Examples 1 to 4 and Comparative examples 1 and 2 by means of DOCUCENTRE COLOR 6500 (described above). The image formations is prepared by placing toners 1 to 6 and developers 1 to 6 to the positions of a black toner and a black developer of the complex machine.

Figure 3:
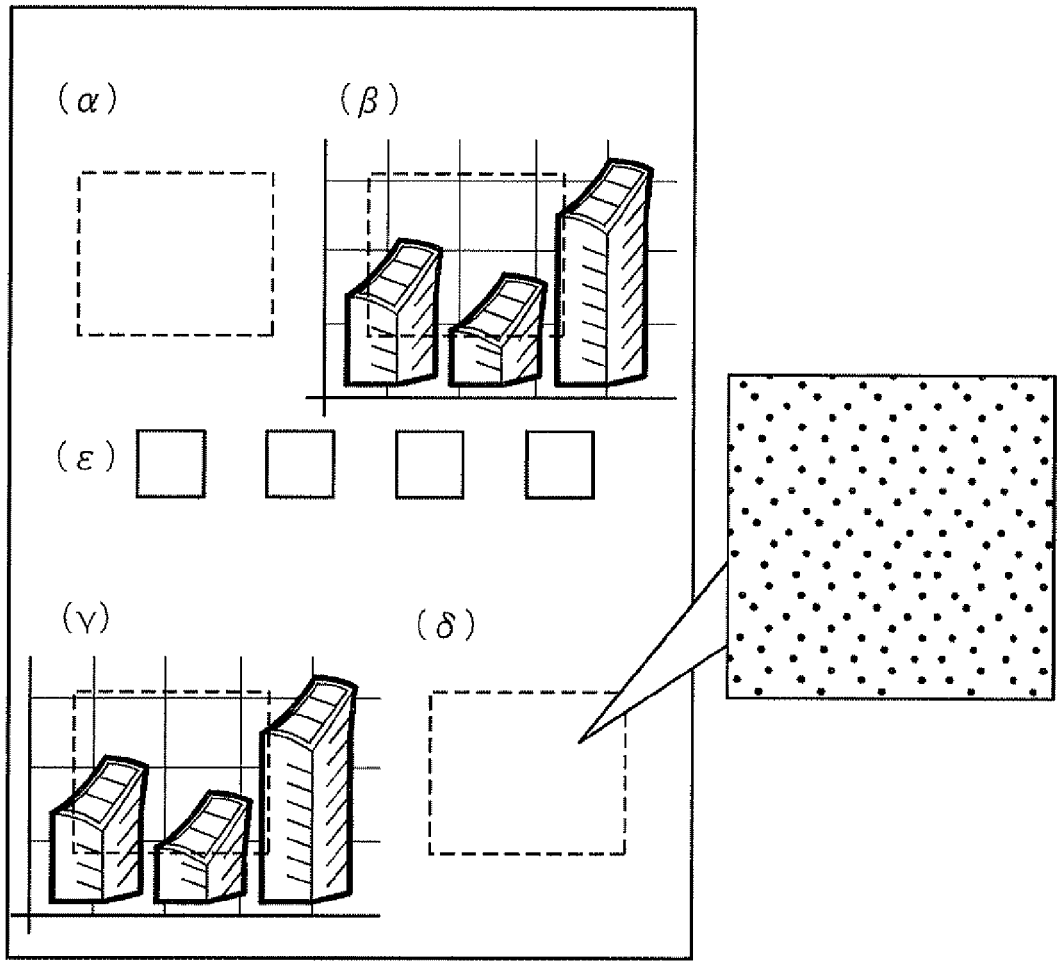
FIG. 3 is a conceptual view illustrating an image to be provided from a personal computer.

The image chart used herein are shown in FIG. 3. The image areas α, β, γ and δ defined by broken lines in the figure are areas in which code patterns described below are printed. In areas β and γ, diagrams containing C, M and Y toners are drawn over code patterns. Four solid quadrangles labeled ϵ are areas in which invisible toners are printed not in codes but as solid patch images. This image is derived from data inputted from an external personal computer into the DOCUCENTRE COLOR 6500 (described above).

The invisible toner code patterns accord to the code patterns disclosed in JP-A No. 2007-179111. In the patterns, information corresponding to 0.071 bits/pixel is displayed by forming nine dot printing areas in a 12×12-pixel block and selecting three areas out of the nine dot printing areas. Two-pixel intervals are formed between one printing area and adjacent printing area, and each dot is composed of two pixels by two pixels. Thus the image area ratio in this case is 8.33%.

Although a magnificated invisible toner pattern is shown in a squared balloon in FIG. 3, the invisible dots in this figure are mere conceptual images and may not be actually seen like those by the naked eye.

Samples formed by printing the image chart of FIG. 3 with the invisible toners are subjected to the following tests to evaluate dot readability and resistance against light.

The invisible codes in the four areas in the image chart of FIG. 3 formed in each of the samples are red with a pen-shaped infrared reader and an error rate explained below is determined. The samples are then put in a machine for testing resistance against light which is equipped with a fluorescent lamp, and are taken out at given times (initial, 16 hours, 32 hours, 65 hours and 260 hours) and examined for the error rate in reading of the code portions and the change in the amount of infrared absorption of solid patch image portions. The results are shown in Table 1 (error rate) and FIG. 4 (change in the amount of infrared absorption).

TABLE 1

| | Initial | 16 hours | 32 hours | 65 hours | 260 hours |
|---|---|---|---|---|---|
| Example 1 | 1.25% | 1.23% | 1.26% | 1.38% | 1.54% |
| Example 2 | 0.90% | 1.39% | 1.47% | 1.59% | 1.89% |
| Example 3 | 1.58% | 1.60% | 1.55% | 1.62% | 1.64% |
| Example 4 | 1.80% | 1.87% | 1.98% | 2.24% | 4.81% |
| Comparative example 1 | 1.16% | 3.52% | 9.86% | 89.4% | — |
| Comparative example 2 | 1.42% | 5.22% | 12.6% | 95.1% | — |

The error rate in the reading of invisible codes by with a pen-shaped infrared reader is calculated as follows.

A part which is expected to have 256 dotted sites is captured at once with a pen-shaped infrared reader. Whether a dot is present or not at each site is judged, and the number of sites where false judgment was made is determined through comparison to a table in which the presence or absence of dots is correctly shown and the number ratio of the number of the sites where false judgment was made to the number of all the sites (the number of error sites/the number of all sites) is thereby calculated. When an area containing dots is judged as being an area containing no dots or when an area containing no dots is judged as being an area containing dots, the judgement is a false judgment (an error). Each area of the four areas in the image chart is subjected to measurement for 10 times while the measuring site is shifted slightly within the area. The same operation is performed for all of the four areas, followed by the calculation of the average of the number ratio and the distribution of the number ratio. The reading property of the sample is evaluated on the basis of the error rate, that is the addition of the average of the number ratio and two sigmas of the distribution of the number ratio. The error rate varies as the pen-shaped infrared reader is inclined with respect to the face of the sample (paper with the printed dots). In this test, the error rate is measured under severe conditions, that is, in a state that the pen-shaped infrared reader is inclined 45° from a direction perpendicular to the paper (in other words, in a state that the optical axis of the optical system of the reader is inclined 45° with respect to a line perpendicular to the paper).

The test of resistance against light is performed by irradiating the chart printed in each samples with light (light source: white fluorescent lamp; irradiance: 62.5 klux; irradiation through 2 mm-thick soda lime glass sheet) and measuring a spectrum of the solid patch image with a spectrophotometer U-4000 (described above). The relative amount of infrared absorption of the ordinate of FIG. 4 is determined by convoluting the spectrum of the reading sensitivity of the pen-shaped infrared reader to the spectrum of the solid patch image.

The error rate is herein desired to be 2% or less. As shown in Table 1, the invisible toners of Comparative examples 1 and 2 are not specifically problematic with initial reading, but the reading error rapidly exceeds 2% and the products become practically non-tolerable when time lapses even under light from a fluorescent lamp. As shown in FIG. 4, the difference between Examples and Comparative examples is also large with respect to the relative change in the amount of infrared absorption. The time taken until the relative change decreases by one-half shown in FIG. 4 indicates that the resistance against light Examples is ten times or more higher than that of Comparative examples. The increase in the error rate of Example 4 is slightly larger than that of Examples 1 to 3.

Figure 4:
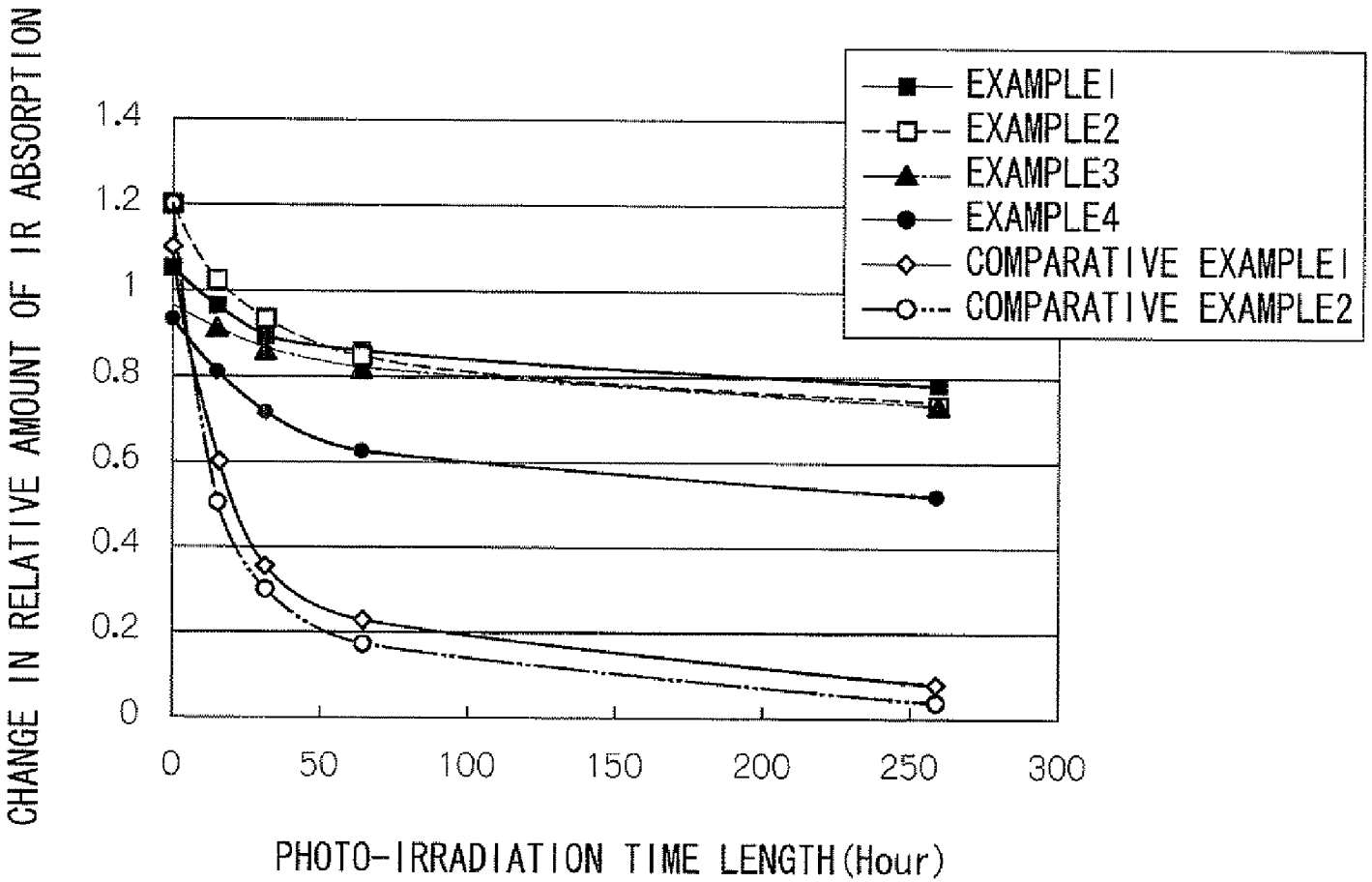
FIG. 4 is graph showing changes in the amount of infrared absorption.

Judging from FIG. 4, this is probably caused by the fact that the dispersed particle diameter of the infrared absorber of Example 4 is larger, which may lead to the smaller initial amount of infrared absorption, and may further lead to a phenomenon in which the amount of infrared absorption of Example 4 exceeds a threshold necessary for pen reading before causing photodegradation. Although such phenomenon may be addressed by increasing the content of infrared absorbers, it may not be always suitable in view of reducing amounts of infrared absorbers, which may require high costs.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

What is claimed is:

1. An electrophotographic toner comprising a binder resin and an infrared absorber, the infrared absorber comprising a perimidine-squarylium dye represented by the following Formula (1):

(I)

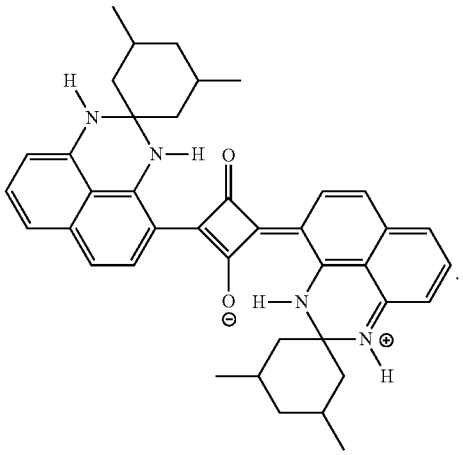

2. The electrophotographic toner of claim 1, wherein the perimidine-squarylium dye represented by Formula (1) is a crystalline particle which exhibits diffraction peaks at Bragg angles (2θ±0.2 degrees) of about 9.9°, about 13.2°, about 19.9°, about 20.8° and about 23.0° in a powder X-ray diffraction spectrum observed by irradiation with an X-ray having a wavelength of about 1.5405 Å using Cu as a target.

3. The electrophotographic toner of claim 1, wherein the perimidine-squarylium dye represented by Formula (1) has a median diameter D50 of from about 80 nm to about 200 nm, a 16%-volume particle diameter of about 40 nm or more, and an 84%-volume particle diameter of about 300 nm or less.

4. The electrophotographic toner of claim 1, wherein the electrophotographic toner is formed by an emulsion polymerization aggregation method, and the shape factor SF1 of the electrophotographic toner is in the range of from 120 to 140.

5. The electrophotographic toner of claim 1, wherein the content of the perimidine-squarylium dye represented by Formula (1) is from about 0.5% by weight to about 2% by weight with respect to the total amount of the electrophotographic toner.

6. The electrophotographic toner of claim 1, wherein the median diameter of the electrophotographic toner is in the range of from about 3 μm to about 10 μm.

7. The electrophotographic toner of claim 1, further comprising a release agent.

8. The electrophotographic toner of claim 1, wherein the content of the release agent is in the range of from about 1% by weight to about 15% by weight with respect to the total amount of the electrophotographic toner.

9. The electrophotographic toner of claim 1, wherein the reflectance of a fixed image formed from the electrophotographic toner at about 450 nm is about 0.7 or more.

10. An invisible electrophotographic toner comprising a binder resin and an infrared absorber, the infrared absorber comprising a perimidine-squarylium dye represented by the following Formula (1):

(I)

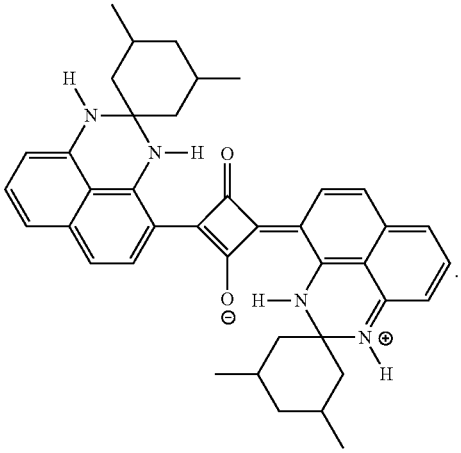

11. The invisible electrophotographic toner of claim 10, wherein the perimidine-squarylium dye represented by Formula (1) is a crystalline particle which exhibits diffraction peaks at Bragg angles (2θ±0.2 degrees) of about 9.9°, about 13.2°, about 19.9°, about 20.8° and about 23.0° in a powder X-ray diffraction spectrum observed by irradiation with an X-ray having a wavelength of about 1.5405 Å using Cu as a target.

12. The invisible electrophotographic toner of claim 10, wherein the perimidine-squarylium dye represented by Formula (1) has a median diameter D50 of from about 80 nm to about 200 nm, a 16%-volume particle diameter of about 40 nm or more, and an 84%-volume particle diameter of about 300 nm or less.

13. The invisible electrophotographic toner of claim 10, wherein the content of the perimidine-squarylium dye represented by Formula (1) is from about 0.5% by weight to about 2% by weight with respect to the total amount of the invisible electrophotographic toner.

14. The invisible electrophotographic toner of claim 10, further comprising a release agent.

15. The invisible electrophotographic toner of claim 10, wherein the content of the release agent is in the range of from about 1% by weight to about 15% by weight with respect to the total amount of the invisible electrophotographic toner.

16. The invisible electrophotographic toner of claim 10, wherein the reflectance of a fixed image formed from the invisible electrophotographic toner at about 450 nm is about 0.7 or more.

17. An electrophotographic developer comprising the invisible electrophotographic toner of claim 10.

18. The electrophotographic developer of claim 17, wherein the charge amount of the invisible electrophotographic toner is in the range of from about 205 μC/g to about 80 μC/g.

19. A toner cartridge comprising the invisible electrophotographic toner of claim 10.

20. A process cartridge equipped with at least a developer holder and comprising the electrophotographic developer of claim 17.

21. An image forming apparatus comprising:

an image holder;

a charging unit which charges the surface of the image holder;

an electrostatic latent image forming unit which forms an electrostatic latent image on the surface of the image holder charged by the electrostatic latent image forming unit;

a developing unit which develops the electrostatic latent image formed on the surface of the image holder with the electrophotographic developer of claim 17 to form a toner image;

a transferring unit which transfers the toner image formed on the surface of the image holder to a surface of a receiver; and a fixing unit which fixes the transferred image transferred on the surface of the receiver.

* * * * *